US011128079B2

(12) United States Patent
Ono et al.

(10) Patent No.: US 11,128,079 B2
(45) Date of Patent: Sep. 21, 2021

(54) CONNECTOR WITH RETAINER FOR HOLDING OBLIQUELY WOUND SPRING

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventors: Takuya Ono, Yokkaichi (JP); Nobuyuki Akiba, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/982,297

(22) PCT Filed: Mar. 22, 2019

(86) PCT No.: PCT/JP2019/011999
§ 371 (c)(1),
(2) Date: Sep. 18, 2020

(87) PCT Pub. No.: WO2019/193992
PCT Pub. Date: Oct. 10, 2019

(65) Prior Publication Data

US 2021/0013655 A1 Jan. 14, 2021

(30) Foreign Application Priority Data

Apr. 4, 2018 (JP) ..... JP2018-072671

(51) Int. Cl.
*H01R 13/02* (2006.01)
*H01R 13/18* (2006.01)
*H01R 13/6583* (2011.01)

(52) U.S. Cl.
CPC ..... *H01R 13/18* (2013.01); *H01R 13/6583* (2013.01)

(58) Field of Classification Search
CPC ..... H01R 13/18; H01R 13/15; H01R 13/17; H01R 13/10; H01R 13/02; H01R 13/6583;
(Continued)

(56) References Cited

U.S. PATENT DOCUMENTS 2,761,111 A * 8/1956 Klostermann ..... H01R 13/633 439/271
3,835,443 A * 9/1974 Arnold ..... H01R 13/6583 439/319
(Continued)

FOREIGN PATENT DOCUMENTS

JP S50-47188 A 4/1975
JP S59-158078 A 9/1984
(Continued)

OTHER PUBLICATIONS

Jun. 4, 2019 International Search Report issued in International Patent Application No. PCT/JP2019/011999.

*Primary Examiner* — Harshad C Patel
(74) *Attorney, Agent, or Firm* — Oliff PLC

(57) ABSTRACT

A connector, including: a first connector including a first housing and a tubular first shield made of metal and supported in the first housing; a second connector including a second housing to be coupled to the first housing and a tubular second shield made of metal and provided in the second housing, an axial end of the second shield r being arranged to overlap the first shield in a radial direction; an
(Continued)

obliquely wound spring arranged between the first shield and the second shield in the radial direction, the obliquely wound spring making the first and second shields electrically conductive with each other; and a retainer made of an insulator, the retainer including a spring holder that holds the obliquely wound spring, the retainer being provided between the first shield and the second shield in the radial direction.

4 Claims, 5 Drawing Sheets

(58) Field of Classification Search
CPC ... H01R 13/681; H01R 13/658; H01R 13/648
USPC ..... 439/816
See application file for complete search history.

(56) References Cited

U.S. PATENT DOCUMENTS 4,033,654 A * 7/1977 Ross ..... H01R 13/6583 439/607.17
4,330,166 A * 5/1982 Cooper ..... H01R 13/6583 439/607.18
4,464,000 A * 8/1984 Werth ..... H01R 13/622 439/312
4,502,748 A * 3/1985 Brush, Sr. ..... H01R 13/622 439/313
4,529,257 A * 7/1985 Goodman ..... H01R 13/6584 439/271
4,623,858 A * 11/1986 Montesanto ..... H01P 1/042 333/255
7,588,461 B2 9/2009 Tyler
7,914,351 B2 * 3/2011 Balsells ..... H01R 13/187 439/840
7,955,145 B2 * 6/2011 Chansrivong ..... H01R 13/533 439/840
8,282,429 B2 * 10/2012 Glick ..... H01R 13/187 439/843
8,342,893 B2 * 1/2013 Glick ..... H01R 13/187 439/840
9,829,028 B2 * 11/2017 Changsrivong ..... F16B 21/186
2011/0280653 A1 11/2011 Sjostedt et al.
2013/0137310 A1 * 5/2013 Genau ..... H01R 13/504 439/660
2014/0219713 A1 8/2014 Balsells et al.
2015/0240900 A1 8/2015 Poon et al.

FOREIGN PATENT DOCUMENTS

JP 2008-204634 A 9/2008
JP 2011-515788 A 5/2011
JP 2011-243572 A 12/2011
JP 2013-537693 A 10/2013
JP 2015-180830 A 10/2015
JP 2016-507711 A 3/2016

* cited by examiner

CONNECTOR WITH RETAINER FOR HOLDING OBLIQUELY WOUND SPRING

BACKGROUND

The present disclosure relates to a connector.

Conventionally, in a connector with a male connector including a male terminal and a female connector including a female terminal, each of the male and female connectors is provided with a tubular shield member and the respective shield members are made electrically conductive with each other by connecting the male and female connectors.

As a structure for conduction of respective shield members, one shield member is integrally formed with contact point portions (front spring 444) with the other shield member, for example, in a connector of Japanese Unexamined Patent Publication No. 2011-515788. Further, in this structure, a plurality of the contact point portions are formed to increase a contact area. In this configuration, the shield member itself has to be made of a material having a high strength to ensure the rigidity of the contact point portions integrally formed to the shield member, which leads to a problem of high cost.

To solve this problem, it is considered to apply a conductive structure using an obliquely wound spring (spring contact), for example, as shown in Japanese Unexamined Patent Publication No. 2008-204634. For example, a holding groove is formed in the outer peripheral surface of one shield member and the obliquely wound spring held in the holding groove is sandwiched in a radial direction by respective shield members, whereby the respective shield members can be made conductive with each other via the obliquely wound spring. Further, since the obliquely wound spring is in contact with the respective shield members at a plurality of contact points, a sufficient contact area can be secured. According to this configuration, a degree of freedom in selecting a material used for the shield members is improved since contact point portions are not integrally formed to the shield members.

SUMMARY

In the above configuration using the obliquely wound spring for the conduction of the respective shield members, since the shield member is formed with the holding groove for holding the obliquely wound spring, the shield member needs to be thickened, which is disadvantageous in reducing the weight of the connector.

An exemplary aspect of the disclosure provides a connector capable of holding an obliquely wound spring while shield members are configured to be thin.

A connector according to an exemplary aspect of the disclosure is provided with a first connector including a first housing and a tubular first shield made of metal and supported in the first housing, a second connector including a second housing to be coupled to the first housing and a tubular second shield made of metal and provided in the second housing, an axial end of the second shield being arranged to overlap the first shield in a radial direction, an obliquely wound spring arranged between the first shield and the second shield in the radial direction, the obliquely wound spring making the first and second shields electrically conductive with each other, and a retainer made of an insulator, the retainer including a spring holder that holds the obliquely wound spring, the retainer being provided between the first shield and the second shield in the radial direction.

According to the above aspect, since the obliquely wound spring can be held by the retainer, the shields themselves need not be formed with a holding portion such as a groove for holding the obliquely wound spring. Thus, the obliquely wound spring can be held by the retainer while the shields are configured to be thin.

In the above connector, the retainer includes a movement restrictor that restricts a movement in an axial direction of a seal that prevents water intrusion to the obliquely wound spring.

According to the above aspect, since the retainer has both a function of holding the obliquely wound spring and a function of restricting a movement in the axial direction of the seal, an increase in the number of components can be maximally suppressed.

In the above connector, the retainer includes a locking lock that locks the first shield in the axial direction and is configured to be capable of holding the first shield with respect to the first housing.

According to the above aspect, since the retainer has both the function of holding the obliquely wound spring and a function of holding the first shield with respect to the first housing, an increase in the number of components can be maximally suppressed.

In the above connector, the first shield is formed into a hollow cylindrical shape, and the retainer includes a positioner that positions the retainer in a circumferential direction with respect to the first shield.

According to the above aspect, the retainer can be positioned in the circumferential direction with respect to the hollow cylindrical first shield.

According to the connector of the present disclosure, the obliquely wound spring can be held while the shields are configured to be thin.

DETAILED DESCRIPTION OF EMBODIMENTS

Hereinafter, one embodiment of a connector is described.

Figure 1:
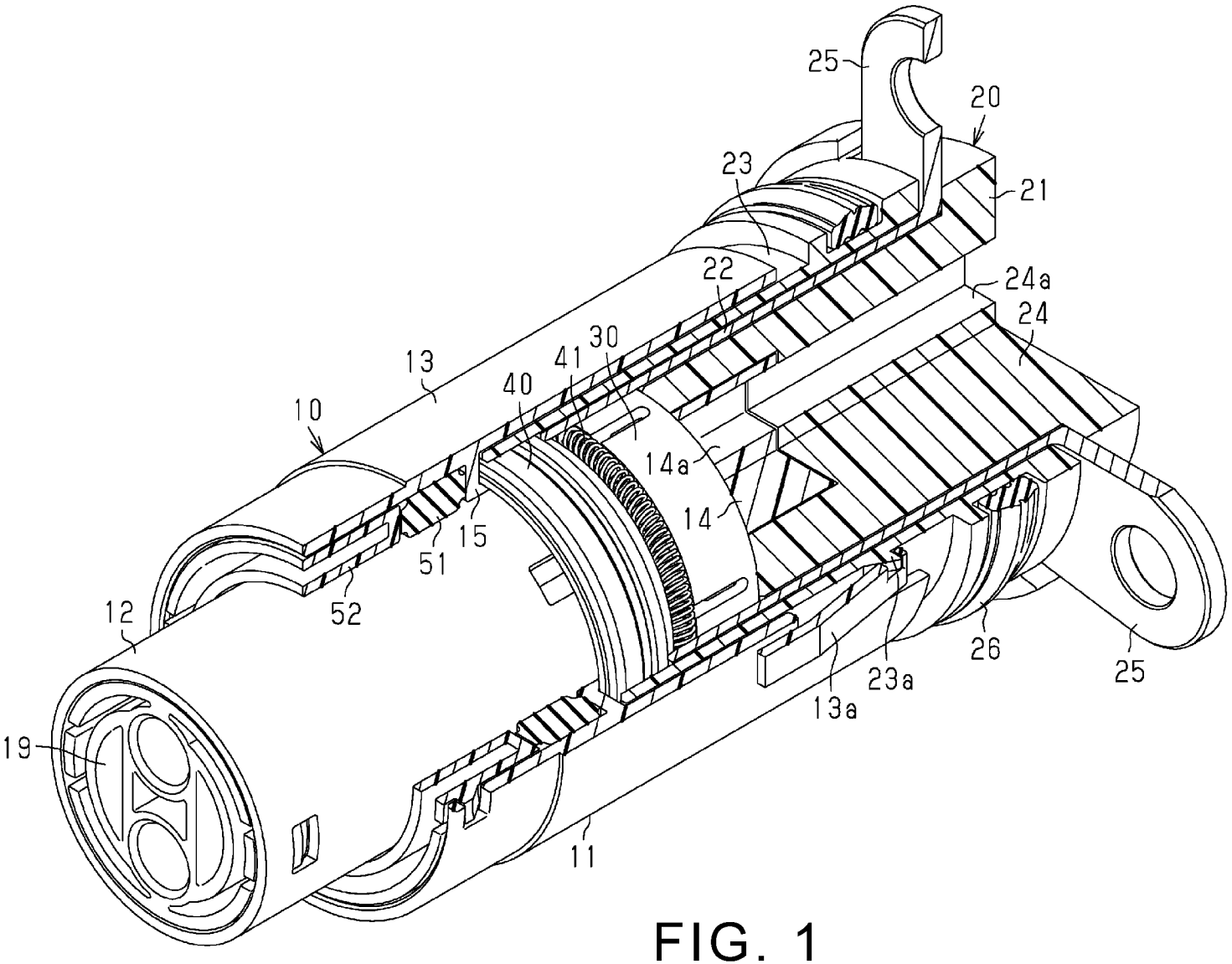
FIG. 1 is a perspective view partly in section showing a connector of an embodiment.

The connector of this embodiment shown in FIG. 1 is used, for example, in a connection part in a high-voltage wiring harness of a vehicle and includes a first connector 10 and a second connector 20 to be assembled with each other. In this embodiment, the first connector 10 is a female connector and the second connector 20 is a male connector. Further, a retainer 30 is assembled with the first connector 10.

The first connector 10 includes a first housing 11, which is an injection molded article of synthetic resin, and a first shield member 12 (first shield) made of metal (e.g. aluminum-based metal) and provided in the first housing 11.

Figure 2:
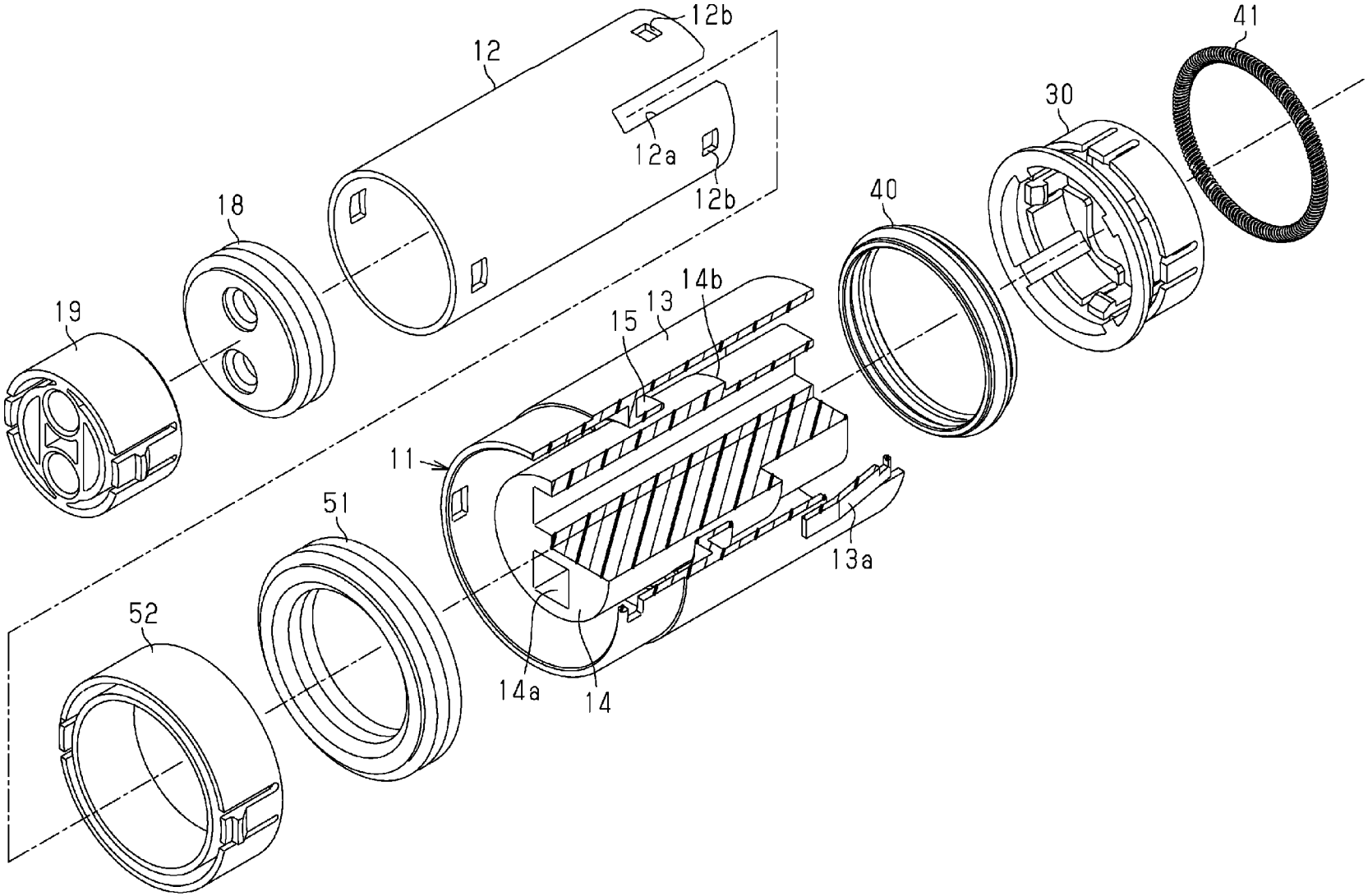
FIG. 2 is an exploded perspective view of the connector (first connector side) of the embodiment of FIG. 1.

As shown in FIG. 2, the first shield member 12 is formed into a hollow cylindrical shape. The first shield member 12 includes slits 12*a* linearly formed along an axial direction from a tip surface (end part on the side of the second connector 20) in the axial direction. Four slits 12*a* are provided at intervals of 90° in a circumferential direction. Further, locking holes 12*b* to be locked to locking claws 36 of the retainer 30 to be described later are formed in a tip side (end side on the side of the second connector 20) in the axial direction of the first shield member 12. Four locking holes 12*b* are provided at intervals of 90° in the circumferential direction. The respective locking holes 12*b* are provided between adjacent ones of the respective slits 12*a* in the circumferential direction. More particularly, the locking holes 12*b* and the slits 12*a* are alternately provided at intervals of 45° in the circumferential direction.

Figure 3:
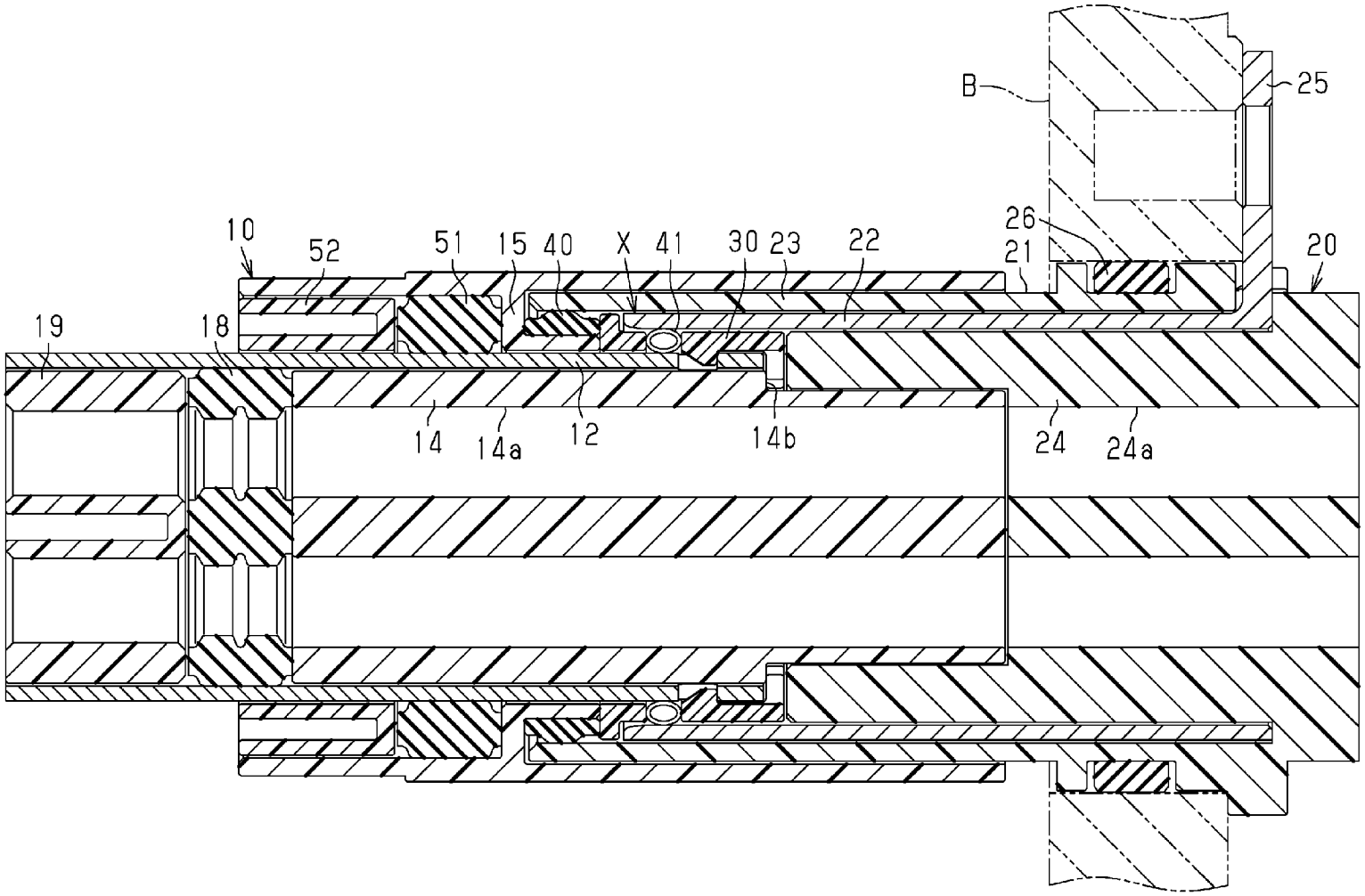
FIG. 3 is a section of the connector of the embodiment of FIG. 1.

As shown in FIGS. 2 and 3, the first housing 11 includes a hollow cylindrical outer peripheral wall portion 13 and a terminal holding portion 14 provided inside the outer peripheral wall portion 13. A rubber ring holding portion 15 having a circular ring shape centered on an axis of the outer peripheral wall portion 13 is formed on an inner peripheral side of an axially intermediate part of the outer peripheral wall portion 13.

Figure 4:
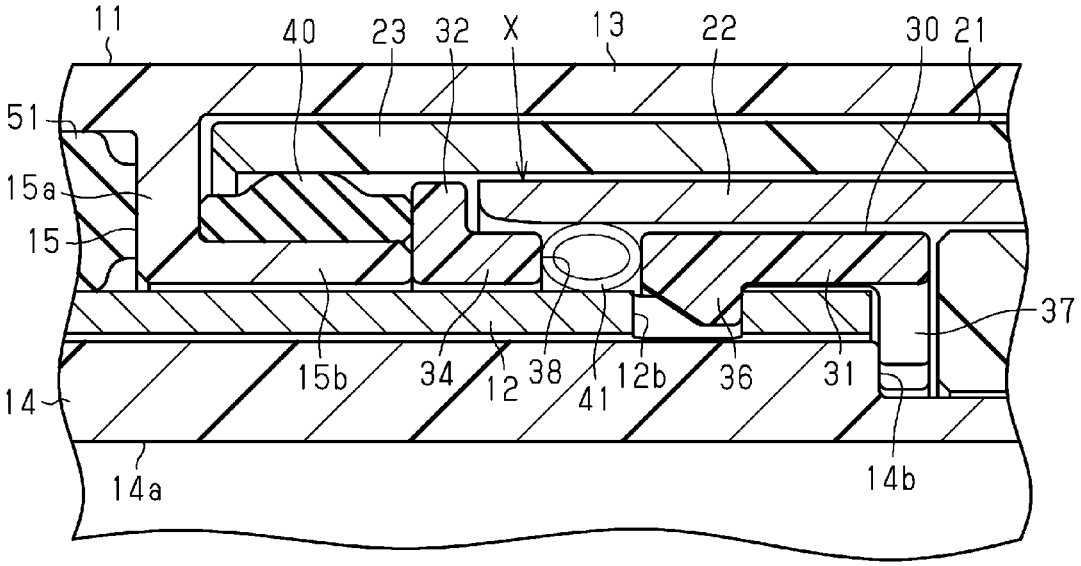
FIG. 4 is a section partially enlargedly showing the connector of the embodiment of FIG. 1.

As shown in FIG. 4, the rubber ring holding portion 15 includes a radially extending portion 15*a* extending radially inward from the inner peripheral surface of the outer peripheral wall portion 13 and an axially extending portion 15*b* extending from an inner peripheral end part of the radially extending portion 15*a* toward one side in the axial direction (axial direction of the first housing 11). The radially extending portion 15*a* is in the form of a plate perpendicular to the axial direction and formed into a circular ring shape along the inner peripheral surface of the outer peripheral wall portion 13. The axially extending portion 15*b* is formed into a hollow cylindrical shape coaxial with the outer peripheral wall portion 13.

Figure 5:
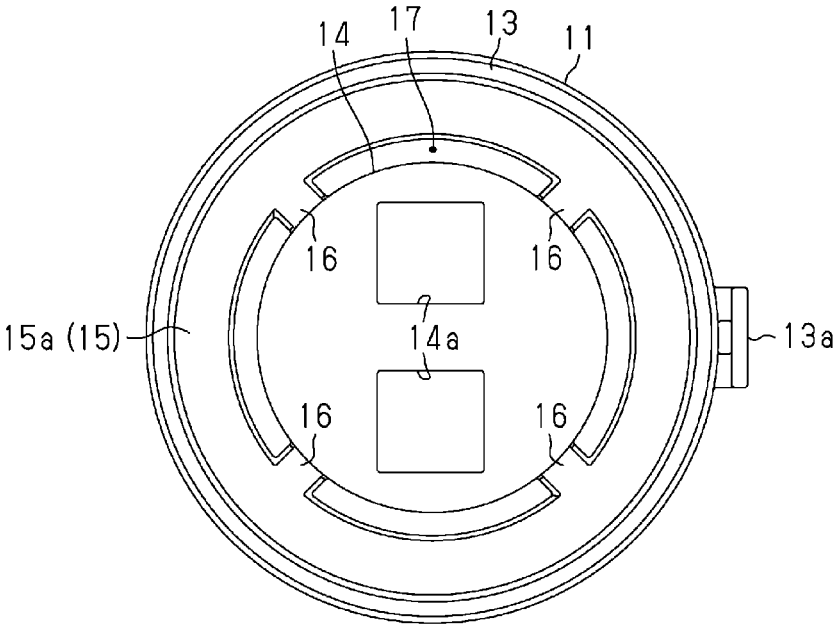
FIG. 5 is a side view of a first housing of the embodiment of FIG. 1 viewed from an axial direction.

As shown in FIG. 5, the terminal holding portion 14 is provided on an inner peripheral side of the rubber ring holding portion 15 and linked to the rubber ring holding portion 15 (axially extending portion 15*b*) via four coupling portions 16 provided at intervals of 90° in the circumferential direction. Each coupling portion 16 extends radially inward from the inner peripheral surface of the rubber ring holding portion 15 (axially extending portion 15*b*) and is linked to the outer peripheral surface of the terminal holding portion 14 circular when viewed in the axial direction. Gaps 17 are formed between the outer peripheral surface of the terminal holding portion 14 and the inner peripheral surface of the rubber ring holding portion 15 (axially extending portion 15*b*) except at the respective coupling portions 16.

Each coupling portion 16 is fit (inserted) into each slit 12*a* of the first shield member 12 and in contact with a base end (closed end) of each slit 12*a* in the axial direction. In this way, each coupling portion 16 is positioned on a tip side (side of the second connector 20) in the axial direction of the first shield member 12. Further, each coupling portion 16 is engaged with each slit 12*a* in the circumferential direction, whereby the first shield member 12 is positioned in the circumferential direction with respect to the first housing 11. Note that parts of the first shield member 12 between the respective slits 12*a* are inserted into the gaps 17 between the terminal holding portion 14 and the rubber ring holding portion 15.

As shown in FIGS. 3 and 5, the terminal holding portion 14 is formed with a pair of accommodation holes 14*a* penetrating through the terminal holding portion 14 along the axial direction of the first housing 11 (outer peripheral wall portion 13). Unillustrated plus-side and minus-side female terminals and the tips of wires connected to the female terminals are respectively accommodated into the pair of accommodation holes 14*a*. Note that each wire is pulled out to outside from a base end part of the first shield member 12 through a sealing member 18 (seal) fit in the base end part of the first shield member 12 and a retaining member 19 for retaining the sealing member 18. Note that the retaining member 19 is locked and fixed in the first shield member 12.

As shown in FIG. 1, the base end part of the first shield member 12 projects outward from the first housing 11, and a tubular braided wire (not shown) collectively surrounding the respective wires is externally fit and fixed to this projecting part. Note that a sealing member 51 having a circular ring shape and to be held in contact with the radially extending portion 15*a* of the rubber ring holding portion 15 in the axial direction and a pressing member 52 locked and fixed to the outer peripheral wall portion 13 to press the sealing member 51 are accommodated between the outer peripheral surface of the first shield member 12 and the inner peripheral surface of the outer peripheral wall portion 13 on a base end side (side opposite to the second connector 20) of the first connector 10.

As shown in FIGS. 1 and 3, the second connector 20 includes a second housing 21, which is an injection molded article of synthetic resin, and a second shield member 22 (second shield) made of metal and provided in the second housing 21. Note that the second housing 21 is, for example, formed by insert molding with the second shield member 22 inserted.

The second housing 21 includes a hollow cylindrical outer peripheral wall portion 23 arranged coaxially with the outer peripheral wall portion 13 of the first housing 11 and a terminal holding portion 24 provided inside the outer peripheral wall portion 23. The terminal holding portion 24 is formed with a pair of accommodation holes 24*a* penetrating through the terminal holding portion 24 in the axial direction. Unillustrated plus-side and minus-side male terminals are respectively accommodated in the pair of accommodation holes 24*a*.

The second shield member 22 is mainly formed into a hollow cylindrical shape and located between the inner peripheral surface of the outer peripheral wall portion 23 and the outer peripheral surface of the terminal holding portion 24. The inner peripheral surface of the outer peripheral wall portion 23 and the outer peripheral surface of the second shield member 22 are radially in contact. The second shield member 22 includes a fixing portion 25 extending radially outward from a base end part (end part opposite to a tip side to be inserted into the first housing 11) in the axial direction thereof. The fixing portion 25 is fixed to a device-side body B (see FIG. 3), whereby the second connector 20 is fixed to the device-side body B. Note that a sealing member 26 having a circular ring shape is provided on the outer peripheral surface of the outer peripheral wall portion 23 to seal between the outer peripheral wall portion 23 and the device-side body B. Further, the outer peripheral wall portion 23 extends further toward a tip side in the axial direction than the second shield member 22.

With the first and second connectors 10, 20 assembled, the outer peripheral wall portion 23 and the second shield member 22 are inserted inside the outer peripheral wall portion 13 of the first housing 11. The outer peripheral surface of the outer peripheral wall portion 23 (second housing 21) and the inner peripheral surface of the outer peripheral wall portion 13 (firth housing 11) are in contact with each other (or facing each other across a tiny clearance). Note that the outer peripheral wall portion 13 of the first housing 11 is provided with a snap-fit portion 13*a* to be resiliently locked to a locking projection 23*a* (see FIG. 1) provided on the outer peripheral surface of the outer peripheral wall portion 23 of the second housing 21, and the first and second housings 11, 21 are coupled to each other by the locking of the locking projection 23*a* and the snap-fit portion 13*a*.

The second shield member 22 has a larger diameter than the first shield member 12, and a tip part (end part opposite to the fixing portion 25) in the axial direction of the second shield member 22 is located on an outer peripheral side of the first shield member 12. Specifically, an overlapping portion X in which the first and second shield members 12, 22 radially overlap is configured inside the respective outer peripheral wall portions 13, 23.

As shown in FIGS. 1 to 3, a rubber ring 40 having a circular ring shape and the substantially hollow cylindrical retainer 30 functioning to press the rubber ring 40 are assembled with the first connector 10. The retainer 30 is made of an insulator such as synthetic resin, and an obliquely wound spring 41 for making the first shield member 12 of the first connector 10 and the second shield member 22 of the second connector 20 electrically conductive is mounted on the retainer 30.

As shown in FIG. 4, the rubber ring 40 is arranged between the axially extending portion 15*b* of the rubber ring holding portion 15 and the outer peripheral wall portion 23. The rubber ring 40 is in contact with the radially extending portion 15*a* of the rubber ring holding portion 15 in the axial direction. Further, the rubber ring 40 is in close contact with the outer peripheral surface of the axially extending portion 15*b*.

Figure 6:
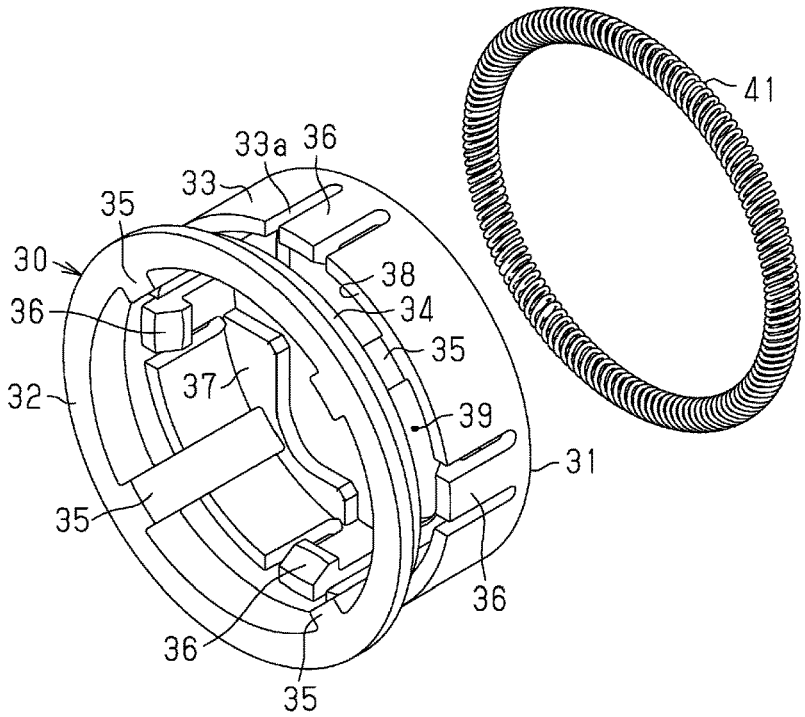
FIG. 6 is an exploded perspective view of a retainer and an obliquely wound spring of the embodiment of FIG. 1.

As shown in FIG. 6, the obliquely wound spring 41 is in the form of a coil formed by winding a conductive wire material a plurality of times, and both end parts of the coiled spring are joined to each other to have a circular ring shape. The obliquely wound spring 41 is a coil spring wound such that each coil winding surface constituting the coil spring is oblique to a coil axis unlike general coil springs. If a load is applied to the obliquely wound spring 41 from an axis orthogonal direction, each winding surface is tilted to be further inclined with respect to the coil axis and the obliquely wound spring 41 is deformed to reduce a dimension in the axis orthogonal direction. The obliquely wound spring 41 has a nonlinear region where a spring load hardly changes even if a displacement amount in the axis orthogonal direction is changed.

Figure 7:
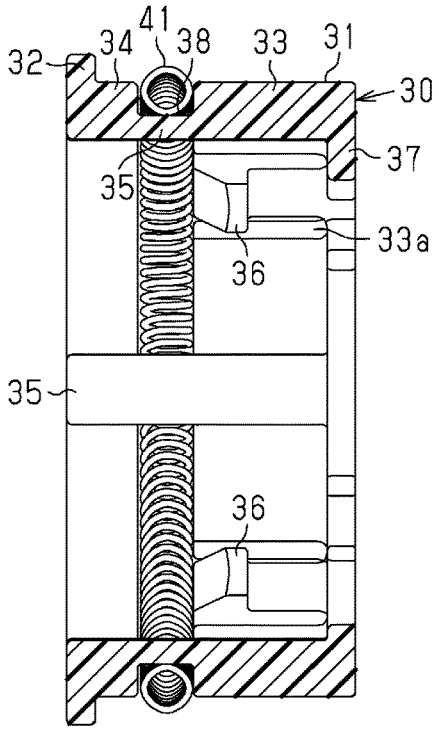
FIG. 7 is a section of the retainer having the obliquely wound spring assembled therewith in the embodiment of FIG. 1.

As shown in FIGS. 4, 6 and 7, the retainer 30 includes a substantially hollow cylindrical retainer body 31 arranged between the first shield member 12 and the second shield member 22 in the radial direction (in the overlapping portion X) with the first and second connectors 10, 20 assembled, and a flange-like movement restricting portion 32 (movement restrictor) extending radially outward from one axial end part of the retainer body 31.

The retainer body 31 includes a first hollow cylindrical portion 33 and a second hollow cylindrical portion 34 juxtaposed in the axial direction and having the same diameter. One axial end part (end part opposite to the first hollow cylindrical portion 33) of the second hollow cylindrical portion 34 is formed with the movement restricting portion 32.

The retainer body 31 is formed with four fitting portions 35 (positioner) arranged at intervals of 90° in the circumferential direction and projecting radially inward from the inner peripheral surface thereof. Each fitting portion 35 extends along the axial direction while straddling between the first and second hollow cylindrical portions 33, 34, and the first and second hollow cylindrical portions 33, 34 are coupled to each other by each fitting portion 35. In an assembled state of the retainer 30, each fitting portion 35 is fit in each slit 12*a* of the first shield member 12 (see FIG. 2).

The first hollow cylindrical portion 33 is formed with four locking claws 36 arranged at intervals of 90° in the circumferential direction and extending toward the second hollow cylindrical portion 34 in the axial direction. Note that each locking claw 36 can be radially deflected by the presence of slits 33*a* formed on both circumferential sides thereof. The respective locking claws 36 are provided at positions shifted in the circumferential direction with respect to the respective fitting portions 35. More particularly, the locking claws 36 and the fitting portions 35 are alternately provided at intervals of 45° in the circumferential direction. In the assembled state of the retainer 30, each locking claw 36 is locked into each locking hole 12*b* of the first shield member 12 in the axial direction (see FIG. 4). In this way, the retainer 30 and the first shield member 12 are fixed not to be separated from each other in the axial direction.

One axial end part (end part opposite to the second hollow cylindrical portion 34) of the first hollow cylindrical portion 33 is formed with a contact wall 37 projecting radially inward. The contact wall 37 is in contact with a step portion 14*b* (see FIG. 4) formed on the outer peripheral surface of the terminal holding portion 14 in the axial direction.

The retainer body 31 includes a spring holding portion 38 (spring holder) for holding the obliquely wound spring 41. The spring holding portion 38 is formed between the first and second hollow cylindrical portions 33, 34. Particularly, the spring holding portion 38 is constituted by the respective end parts of the first and second hollow cylindrical portions 33, 34 facing each other in the axial direction and radially outer side surfaces of the respective fitting portions 35 between the first and second hollow cylindrical portions 33, 34. In the spring holding portion 38, end parts facing each other in the axial direction of the first and second hollow cylindrical portions 33, 34 hold the obliquely wound spring 41 in the axial direction to restrict a movement of the obliquely wound spring 41 in the axial direction. Further, the radially outer side surfaces of the respective fitting portions 35 in the spring holding portion 38 hold an inner peripheral side of the obliquely wound spring 41 in a state before the retainer 30 is assembled (see FIG. 7). Further, gap portions 39 allowing communication between the inside and outside of the retainer body 31 are formed in parts except at the respective fitting portions 35 between the first and second hollow cylindrical portions 33, 34, and the obliquely wound spring 41 is arranged in the gap portions 39.

As shown in FIGS. 3 and 4, in the assembled state of the first and second connectors 10, 20, the obliquely wound spring 41 is arranged between the outer peripheral surface of the first shield member 12 and the inner peripheral surface of the second shield member 22 in the overlapping portion X. The obliquely wound spring 41 is in contact with each of the outer peripheral surface of the first shield member 12 and the inner peripheral surface of the second shield member 22 and interposed between the first and second shield members 12, 22 while being radially resiliently deformed (compressed).

As shown in FIG. 4, the movement restricting portion 32 provided on the second hollow cylindrical portion 34 is in contact with the rubber ring 40 in the axial direction. In this way, the rubber ring 40 is sandwiched and held in the axial direction by the radially extending portion 15*a* of the rubber ring holding portion 15 and the movement restricting portion 32 of the retainer 30. Further, the outer peripheral surface of the rubber ring 40 is in close contact with the inner peripheral surface of the outer peripheral wall portion 23 of the second housing 21. In this way, the intrusion of water having intruded into between the outer peripheral wall portions 13 and 23 to the side of the retainer 30 can be prevented, with the result that the obliquely wound spring 41 (conductive part of the first and second shield members 12, 22) can be prevented from getting wet. Note that, in this embodiment, the movement restricting portion 32 is configured to be able to come into contact with the axially extending portion 15*b* in the axial direction. Further, the spring holding portion 38 is provided between the locking claws 36 and the movement restricting portion 32 in the axial direction.

Next, an assembled mode of the connector of this embodiment is described.

In inserting the first shield member 12 into the base end part in the axial direction of the first housing 11, the respective slits 12*a* of the first shield member 12 are fit to the respective coupling portions 16 of the first housing 11 and the first shield member 12 is inserted until the respective coupling portions 16 come into contact with the base ends (closing ends) of the respective slits 12*a*.

Thereafter, the rubber ring 40 and, subsequently, the retainer 30 having the obliquely wound spring 41 mounted in the spring holding portion 38 are inserted into the first housing 11 from the tip side in the axial direction of the first housing 11. At this time, the retainer 30 is inserted to press the rubber ring 40 by the movement restricting portion 32. In this way, the rubber ring 40 is assembled on the outer peripheral surface of the axially extending portion 15*b* of the rubber ring holding portion 15.

Further, when the retainer 30 is assembled, the respective fitting portions 35 of the retainer 30 are fit into the respective slits 12*a* of the first shield member 12. In this way, the retainer 30 is positioned in the circumferential direction and the circumferential positions of the respective locking claws 36 of the retainer 30 and the respective locking holes 12*b* of the first shield member 12 are aligned. The respective locking claws 36 are locked into the respective locking holes 12*b* by pushing the retainer 30 toward the base end part in the axial direction of the first housing 11, whereby the retainer 30 is fixed to the first shield member 12 while being externally fit on the first shield member 12. In this state, the obliquely wound spring 41 mounted on the retainer 30 is arranged along the outer peripheral surface of the first shield member 12.

Thereafter, when the first and second connectors 10, 20 are assembled, the second shield member 22 is externally fit on the retainer body 31 as shown in FIG. 3. At this time, the obliquely wound spring 41 partially projecting from the outer peripheral surface of the retainer body 31 is contacted by the inner peripheral surface of the second shield member 22 and radially sandwiched by the inner peripheral surface of the second shield member 22 and the outer peripheral surface of the first shield member 12. In this way, the first and second shield members 12, 22 are made electrically conductive with each other via the obliquely wound spring 41. Note that a plurality of contact points are formed between the first and second shield members 12, 22 and the obliquely wound spring 41 in the circumferential direction.

Further, a tip part (inserting tip part) in the axial direction of the outer peripheral wall portion 23 is inserted between the rubber ring 40 and the outer peripheral wall portion 13 (first housing 11) and the inner peripheral surface of the outer peripheral wall portion 23 contacts the outer peripheral surface of the rubber ring 40. In this way, the rubber ring 40 is interposed between the outer peripheral wall portion 23 and the axially extending portion 15*b* while being radially compressed.

Functions of this embodiment are described.

In a state where the first and second connectors 10, 20 are not assembled, the obliquely wound spring 41 is held at a predetermined position in the axial direction on the outer peripheral surface of the first shield member 12 by the spring holding portion 38 of the retainer 30. Further, the retainer 30 functions to press the rubber ring 40 in the axial direction by the movement restricting portion 32. Furthermore, the retainer 30 functions to retain the first shield member 12 to prevent the escape of the first shield member 12 toward the base end side in the axial direction by being locked to the first shield member 12 in the axial direction.

Effects of this embodiment are described.

(1) The connector includes the obliquely wound spring 41 arranged between the first and second shield members 12, 22 in the radial direction to make the first and second shield members 12, 22 electrically conductive with each other, and the retainer 30 made of an insulator, having the spring holding portion 38 for holding the obliquely wound spring 41 and provided between the first and second shield members 12, 22 in the radial direction. According to this configuration, since the obliquely wound spring 41 can be held by the retainer 30, it is not necessary to form a holding portion such as a groove for holding the obliquely wound spring 41, for example, in the outer peripheral surface of the first shield member 12. Thus, the obliquely wound spring 41 can be held by the retainer 30 while the first and second shield members 12, 22 are configured to be thin.

(2) The retainer 30 includes the movement restricting portion 32 for restricting an axial movement of the rubber ring 40 for preventing water intrusion to the obliquely wound spring 41. According to this configuration, the retainer 30 has both a function of holding the obliquely wound spring 41 and a function of restricting an axial movement of the rubber ring 40, an increase in the number of components can be maximally suppressed.

(3) The retainer 30 includes the locking claws 36 for locking the first shield member 12 in the axial direction and configured to be capable of holding the first shield member 12 with respect to the first housing 11. According to this configuration, since the retainer 30 have both the function of holding the obliquely wound spring 41 and a function of holding the first shield member 12 with respect to the first housing 11, an increase in the number of components can be maximally suppressed. Further, since the locking claws 36 are locked into the locking holes 12*b* formed in the first shield member 12, a locking structure with the retainer 30 can be realized by a simple configuration of forming only holes in the first shield member 12.

(4) The first shield member 12 is formed into a hollow cylindrical shape and the retainer 30 includes the fitting portions 35 for positioning the retainer 30 in the circumferential direction with respect to the first shield member 12. According to this configuration, the retainer 30 can be positioned in the circumferential direction with respect to the hollow cylindrical first shield member 12 and the assemblability of the retainer 30 can be improved. Further, since the fitting portions 35 are parts coupling the first and second hollow cylindrical portions 33, 34 of the retainer 30 to each other and also parts for holding the inner peripheral side of the obliquely wound spring 41, the fitting portions 35 can have a plurality of functions, with the result that the configuration of the retainer 30 can be simplified.

(5) The spring holding portion 38 is provided between the locking claws 36 and the movement restricting portion 32 in the axial direction of the retainer 30. Thus, the obliquely wound spring 41 can be provided at a position closer to the movement restricting portion 32 and the rubber ring 40.

This embodiment can be modified and carried out as follows. This embodiment and the following modifications can be carried out in combination without technical contradiction.

Although the spring holding portion 38 is provided between the locking claws 36 and the movement restricting portion 32 in the axial direction of the retainer 30 in the above embodiment, there is no limitation to this. For example, the locking claws 36 may be provided between the spring holding portion 38 and the movement restricting portion 32. In this case, the locking claws 36 are provided on the side of the second hollow cylindrical portion 34.

Although the first shield member 12 can be held with respect to the first housing 11 by locking the retainer 30 to the first shield member 12 in the above embodiment, there is no particular limitation to this. For example, each of the first shield member 12 and the retainer 30 may be individually fixed to the first housing 11.

Although the retainer 30 has the function of restricting an axial movement of the rubber ring 40 by the movement restricting portion 32 in the above embodiment, there is no particular limitation to this. For example, the movement restricting portion 32 can be omitted from the retainer 30 by providing the rubber ring 40 with a locking/fixing portion for the first housing 11 and locking and fixing the rubber ring 40 to the first housing 11.

The number of the slits 12*a* of the first shield member 12 and the number of the coupling portions 16 of the first housing 11 and the number of the fitting portions 35 of the retainer 30 to be inserted into the slits 12*a* are illustrative in the above embodiment, and may be appropriately changed according to the configuration.

The number of the locking holes 12*b* of the first shield member 12 and the number of the locking claws 36 of the retainer 30 to be locked into the locking holes 12*b* are illustrative in the above embodiment, and may be appropriately changed according to the configuration.

Although the obliquely wound spring 41 is annular in the above embodiment, there is no limitation to this and the obliquely wound spring 41 may be divided in the circumferential direction.

Although the first and second shield members 12, 22 are formed into a hollow cylindrical shape in the above embodiment, these may be, for example, formed into a rectangular tube shape besides this.

Although the first connector 10 is a female connector and the second connector 20 is a male connector in the above embodiment, there is no limitation to this and the first connector 10 may be a male connector and the second connector 20 may be a female connector.

Although the connector of the above embodiment is suitable for high-voltage application of the vehicle, the technique of the present disclosure is not limited to the above embodiment and can be applied to connectors used in other than vehicles and can be used for other than the high-voltage application.

The connector of the above embodiment may be called a connector assembly in which the first and second connectors 10, 20 are electrically and mechanically connected.

The present disclosure includes the following examples. The reference signs of constituent elements of the embodiment are used not for limitation, but to assist understanding.

[Note 1]

An connector assembly according to several examples is provided with a male connector and a female connector, a first connector (10) serving as one of the male and female connectors includes a first housing (11), which is a tubular one-piece article made of electrically insulating resin, and a first shield member (12), which is a tubular one-piece article made of conductive metal, coaxial with the first housing (11) and supported in the first housing (11), a second connector (20) serving as the other of the male and female connectors includes a second housing (21), which is a tubular one-piece article made of electrically insulating resin and mechanically coupled to the first housing (11), and a second shield member (22), which is a tubular one-piece article made of conductive metal and surrounded from outside by the second housing (21), the connector assembly further includes an annular obliquely wound spring (41) made of a conductive metal wire material and having a plurality of circularly wound turns and a retainer (30), which is a tubular one-piece article made of electrically insulating resin and having an annular spring holding groove (38) for holding the obliquely wound spring (41), and when the first connector (10) and the second connector (20) are connected, the inner peripheral surface of an end part of the second shield member (22) surrounds the outer peripheral surface of an end part of the first shield member (12) from outside so that the end part of the first shield member (12) and the end part of the second shield member (22) overlap with a predetermined axial overlap length, the spring holding groove (38) of the retainer (30) is arranged between the outer peripheral surface of the end part of the first shield member (12) and the inner peripheral surface of the end part of the second shield member (22) in a radial direction, and the obliquely wound spring (41) is pressed by the outer peripheral surface of the end part of the first shield member (12) and the inner peripheral surface of the end part of the second shield member (22) and are electrically in contact with both the outer peripheral surface of the end part of the first shield member (12) and the inner peripheral surface of the end part of the second shield member (22).

[Note 2]

In several preferred examples, when the first connector (10) and the second connector (20) are connected, the plurality of turns of the conductive metal wire material of the obliquely wound spring (41) are resiliently compressed in the radial direction by the outer peripheral surface of the end part of the first shield member (12) and the inner peripheral surface of the end part of the second shield member (22), whereby each of the plurality of turns of the conductive metal wire material of the obliquely wound spring (41) is elliptical in a cross-sectional view.

[Note 3]

In several preferred examples, when the first connector (10) and the second connector (20) are connected, the plurality of turns of the obliquely wound spring (41) are resiliently inclined in a circumferential direction of the obliquely wound spring (41) by the outer peripheral surface of the end part of the first shield member (12) and the inner peripheral surface of the end part of the second shield member (22) so that a projection view of each turn of the conductive metal wire material of the obliquely wound spring (41) is elliptical.

[Note 4]

In several preferred examples, the obliquely wound spring (41) has a plurality of electrical contact points configured to contact each of the outer peripheral surface of the end part of the first shield member (12) and the inner peripheral surface of the end part of the second shield member (22).

[Note 5]

In several preferred examples, the outer peripheral surface of the end part of the first shield member (12) and the inner peripheral surface of the end part of the second shield member (22) sandwiching the obliquely wound spring (41) in the radial direction are smooth curved surfaces having no projection or no step for restricting a movement of the obliquely wound spring (41) in the axial direction.

It would be apparent to a person skilled in the art that the present disclosure may be embodied in other specific forms without departing from the technical concept thereof. For example, some of the components described in the embodiment (or one or more modes thereof) may be omitted or several components may be combined. The scope of the present disclosure should be determined together with the full scope of equivalents to which the appended claims are entitled by reference to the appended claims.

The invention claimed is:

1. A connector, comprising:

a first connector including a first housing and a tubular first shield made of metal and supported in the first housing;

a second connector including a second housing to be coupled to the first housing and a tubular second shield made of metal and provided in the second housing, an axial end of the second shield being arranged to overlap the first shield in a radial direction;

an obliquely wound spring arranged between the first shield and the second shield in the radial direction, the obliquely wound spring making the first and second shields electrically conductive with each other; and a retainer made of an insulator, the retainer including a spring holder that holds the obliquely wound spring, the retainer being provided between the first shield and the second shield in the radial direction.

2. The connector of claim 1, wherein the retainer includes a movement restrictor that restricts a movement in an axial direction of a seal that prevents water intrusion to the obliquely wound spring.

3. The connector of claim 1, wherein the retainer includes a lock that locks the first shield in an axial direction and is configured to be capable of holding the first shield with respect to the first housing.

4. The connector of claim 1, wherein:

the first shield is formed into a hollow cylindrical shape, and the retainer includes a positioner that positions the retainer in a circumferential direction with respect to the first shield.

* * * * *